US011261603B2

(12) United States Patent
Izumi et al.

(10) Patent No.: US 11,261,603 B2
(45) Date of Patent: Mar. 1, 2022

(54) METALLIC ROOF MATERIAL AND ROOFING METHOD USING SAME

(71) Applicant: Nippon Steel Nisshin Co., Ltd., Tokyo (JP)

(72) Inventors: Keiji Izumi, Tokyo (JP); Yuugo Oota, Tokyo (JP); Tomoyuki Nagatsu, Tokyo (JP); Norimasa Miura, Tokyo (JP); Katsunari Norita, Tokyo (JP)

(73) Assignee: Nippon Steel Nisshin Co., Ltd., Tokyo (JP)

( * ) Notice: Subject to any disclaimer, the term of this patent is extended or adjusted under 35 U.S.C. 154(b) by 0 days.

(21) Appl. No.: 16/614,995

(22) PCT Filed: May 23, 2017

(86) PCT No.: PCT/JP2017/019200
§ 371 (c)(1),
(2) Date: Nov. 19, 2019

(87) PCT Pub. No.: WO2018/216105
PCT Pub. Date: Nov. 29, 2018

(65) Prior Publication Data

US 2020/0199875 A1 Jun. 25, 2020

(51) Int. Cl.
*E04D 3/30* (2006.01)
*E04D 3/36* (2006.01)

(52) U.S. Cl.
CPC ..... *E04D 3/30* (2013.01); *E04D 3/36* (2013.01)

(58) Field of Classification Search
CPC .... E04D 1/18; E04D 1/28; E04D 1/30; E04D 1/2984; E04D 2001/3458;
(Continued)

(56) References Cited

U.S. PATENT DOCUMENTS 1,425,564 A * 8/1922 Whiteside ..... E04D 1/28 52/560
3,667,180 A 6/1972 Tischuk
(Continued)

FOREIGN PATENT DOCUMENTS

CA 2706221 A1 * 12/2010 ..... B28B 19/0015
CN 203008284 6/2013
(Continued)

OTHER PUBLICATIONS

International Preliminary Report on Patentability, counterpart International App. No. PCT/JP2017/019200, dated Dec. 5, 2019 (10 pages) (English translation).
(Continued)

*Primary Examiner* — Christine T Cajilig
(74) *Attorney, Agent, or Firm* — Cook Alex Ltd.

(57) ABSTRACT

A metallic roof material 1 according to the present invention comprises: a front substrate 10 made of a metal sheet, the front substrate 10 comprising a body portion 100 formed into a box shape; a back substrate 11 arranged on a back side of the front substrate 10 so as to cover an opening of the body portion 100; and a core material 12 filled between the body portion 100 and the back substrate 11, the metallic roof material 1 being tightened to a roof base by driving at least one tightening member into the body portion 100, wherein a top plate portion 101 of the body portion 100 comprises at least one protruding rib 3 comprised of at least one protrusion 30 disposed along a side of a polygon or along a circle, and wherein the metallic roof material 1 is configured such that the tightening member is driven into an inner region 3*a* of the protruding rib 3.

8 Claims, 11 Drawing Sheets

(58) Field of Classification Search
CPC .... E04D 2001/3467; E04D 2001/3423; E04D 1/24; E04D 2001/3455; E04D 2001/3494; E04D 3/30; E04D 3/36
See application file for complete search history.

(56) References Cited

U.S. PATENT DOCUMENTS

| | | | | |
|---|---|---|---|---|
| 4,655,020 | A * | 4/1987 | Ginn, Jr. | E04D 3/38 52/521 |
| 4,712,351 | A * | 12/1987 | Kasprzak | E04F 13/0864 52/547 |
| 4,835,930 | A * | 6/1989 | Shida | E04D 1/18 52/519 |
| 5,425,210 | A | 6/1995 | Zafir | |
| 8,984,833 | B2 | 3/2015 | Manser et al. | |
| 9,938,725 | B2 | 4/2018 | Johnson et al. | |
| 10,519,661 | B2 | 12/2019 | Izumi et al. | |
| 10,597,874 | B2 | 3/2020 | Izumi et al. | |
| 2004/0241476 | A1* | 12/2004 | Friedman | B32B 27/08 428/515 |
| 2010/0077689 | A1* | 4/2010 | Kalkanoglu | E04D 1/34 52/555 |
| 2012/0005978 | A1* | 1/2012 | Jenkins | E04D 1/34 52/552 |
| 2014/0305046 | A1* | 10/2014 | Stearns | E04D 3/36 52/58 |
| 2015/0218817 | A1* | 8/2015 | Pisani | E04D 1/28 428/99 |
| 2018/0080228 | A1 | 3/2018 | Izumi et al. | |
| 2019/0119917 | A1 | 4/2019 | Okubo et al. | |
| 2020/0199875 | A1 | 6/2020 | Izumi et al. | |
| 2020/0256064 | A1 | 8/2020 | Nagatsu et al. | |

FOREIGN PATENT DOCUMENTS

| | | | | |
|---|---|---|---|---|
| CN | 207700591 | | 8/2018 | |
| CN | 110662876 | | 1/2020 | |
| DE | 2329935 | | 1/1975 | |
| FR | 927992 | A * | 11/1947 | E04D 1/28 |
| GB | 1390831 | | 4/1975 | |
| JP | S64-037826 | | 3/1989 | |
| JP | H02-197670 | | 8/1990 | |
| JP | 05005351 | A * | 1/1993 | |
| JP | H09-067901 | | 3/1997 | |
| JP | 2001-288854 | | 10/2001 | |
| JP | 2004257040 | A * | 9/2004 | |
| JP | 2008-240321 | | 10/2008 | |
| JP | 2008-303627 | | 12/2008 | |
| JP | 5864015 | | 2/2016 | |
| JP | 2017-066834 | | 4/2017 | |
| JP | 2017-066853 | | 4/2017 | |
| JP | 2017-179862 | | 10/2017 | |

OTHER PUBLICATIONS

International Search Report with English translation and Written Opinion, counterpart International App. No. PCT/JP2017/019200 (dated Jul. 4, 2017) (9 pages).

* cited by examiner

[FIG. 1]
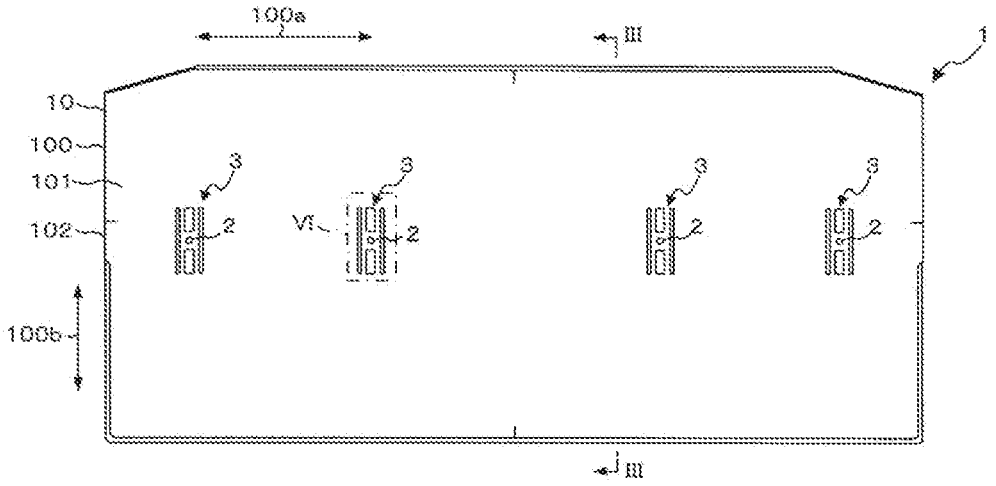

[FIG. 2]
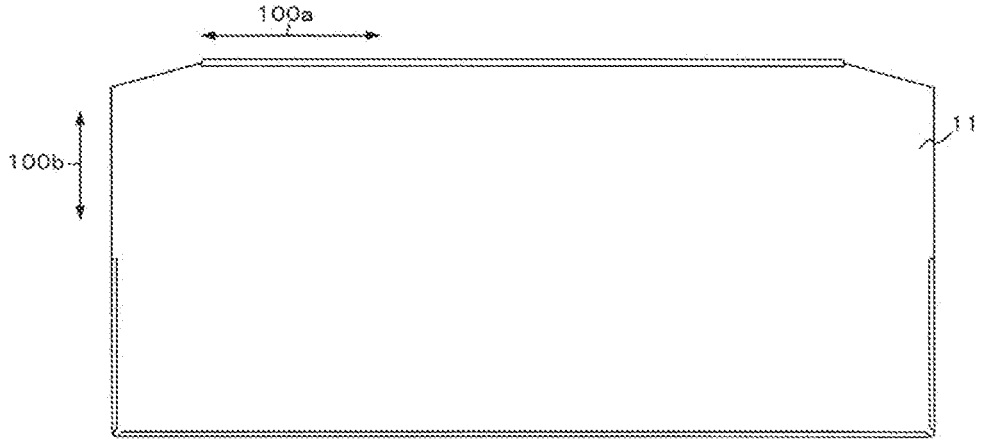

[FIG. 3]
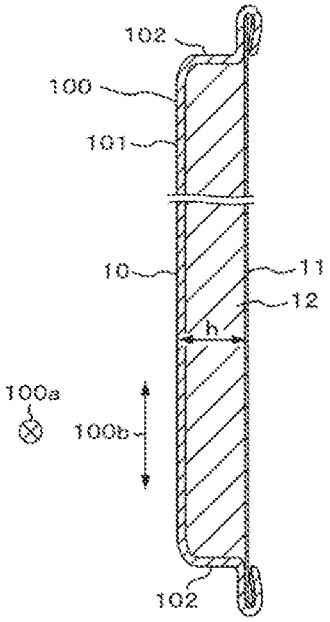

[FIG. 4]
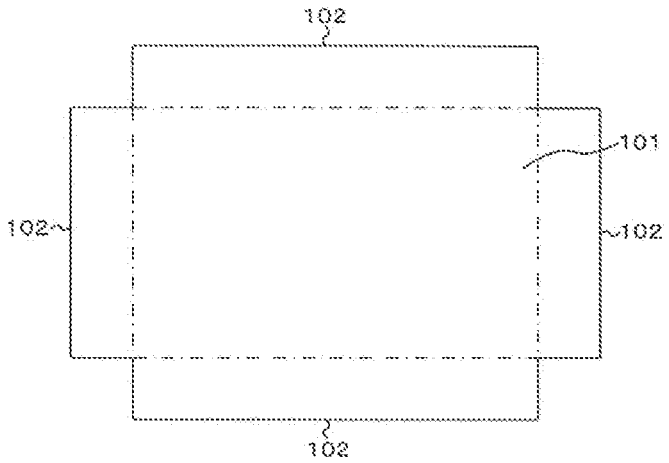

[FIG. 5]
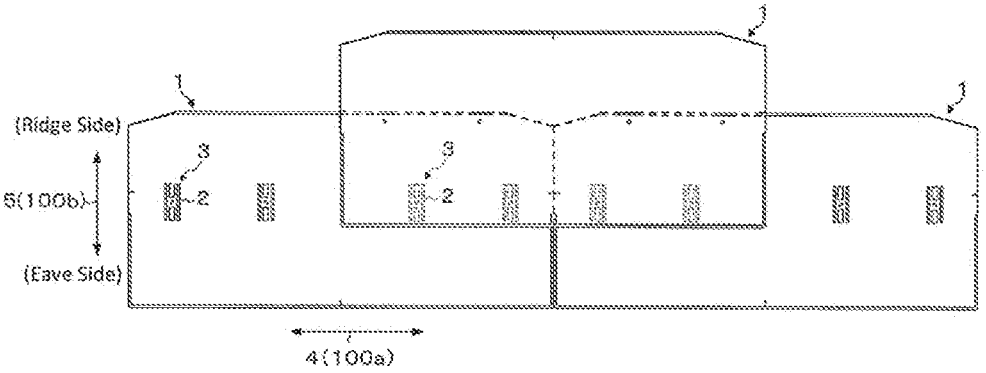

[FIG. 6]
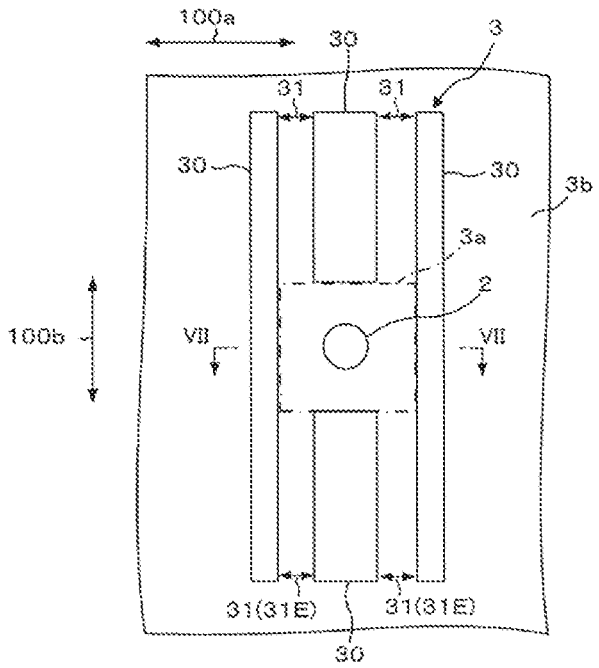

[FIG. 7]
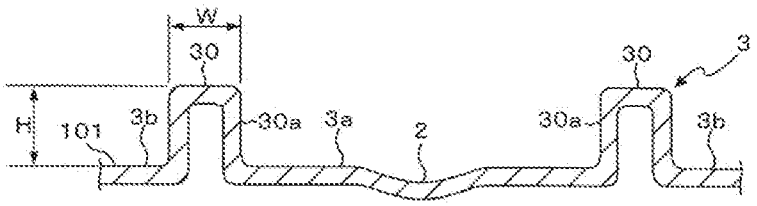

[FIG. 8]
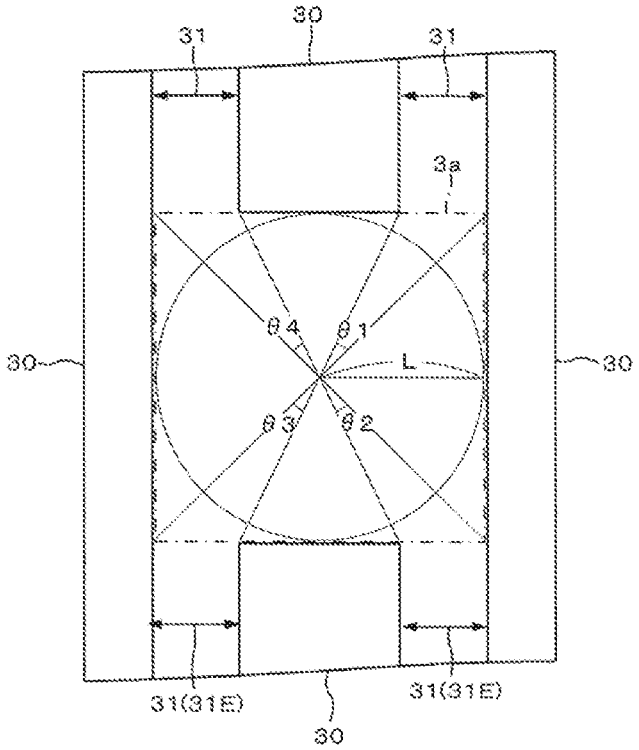

[FIG. 9]
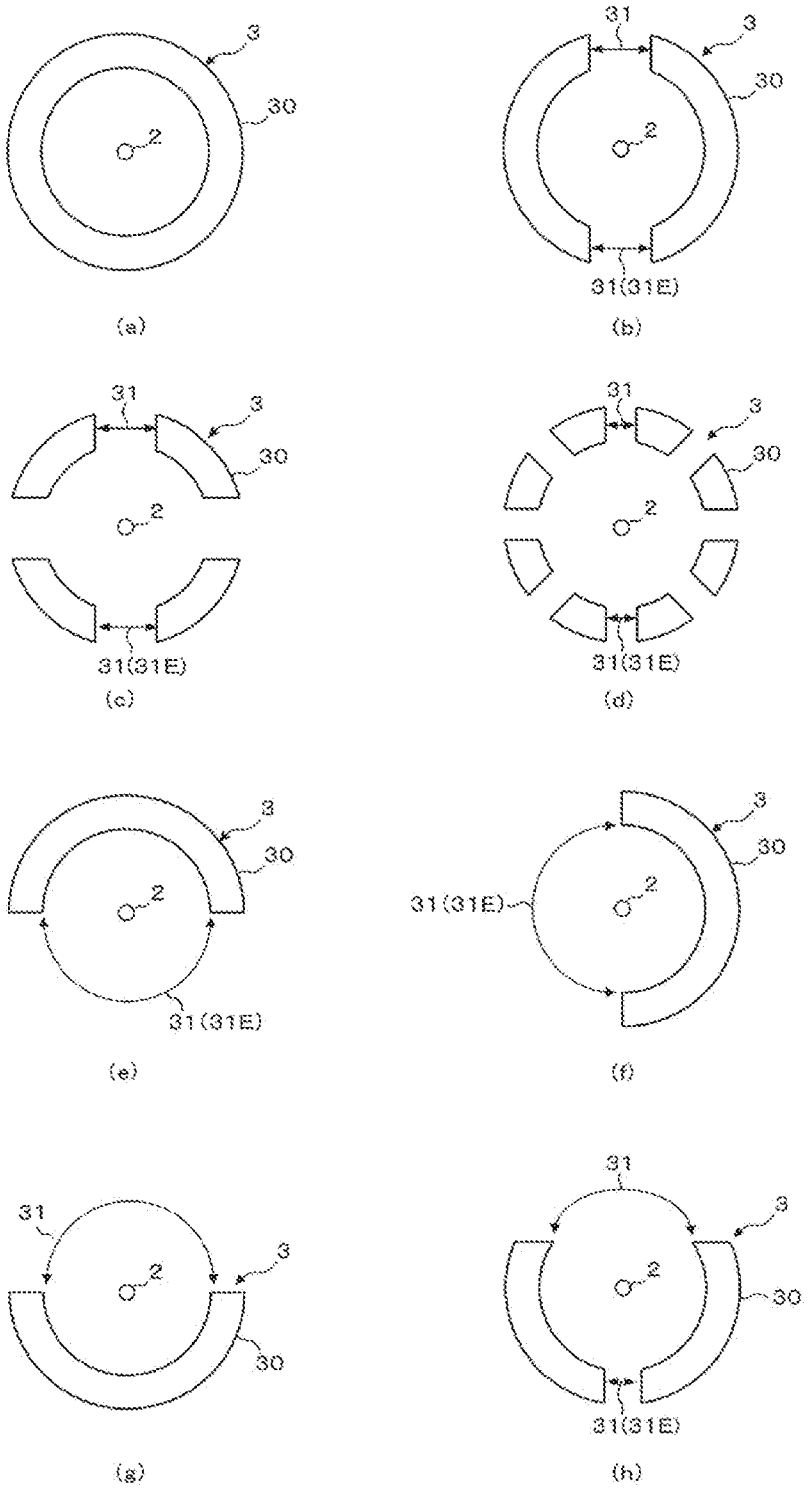

[FIG. 10]
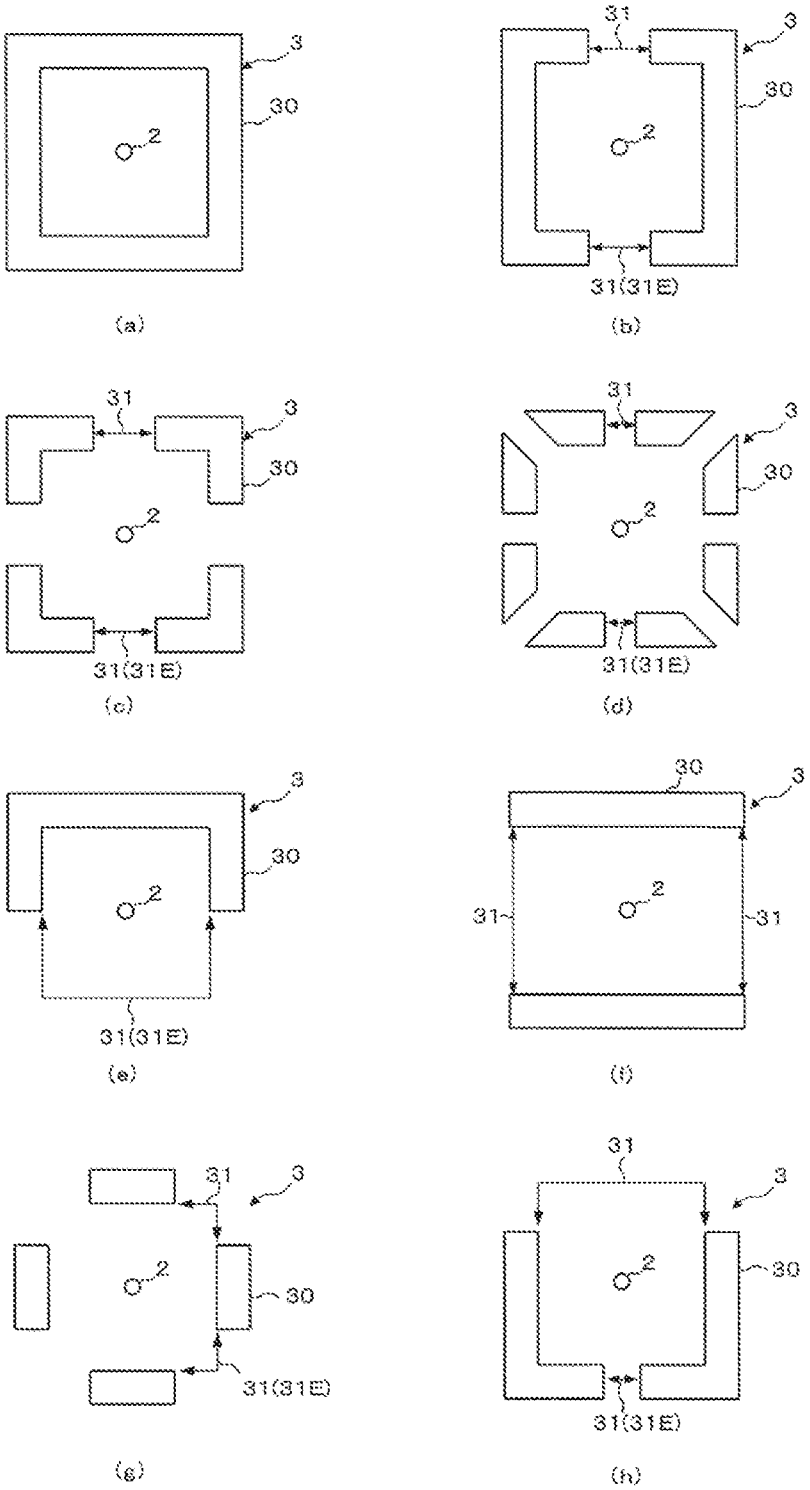

[FIG. 11]
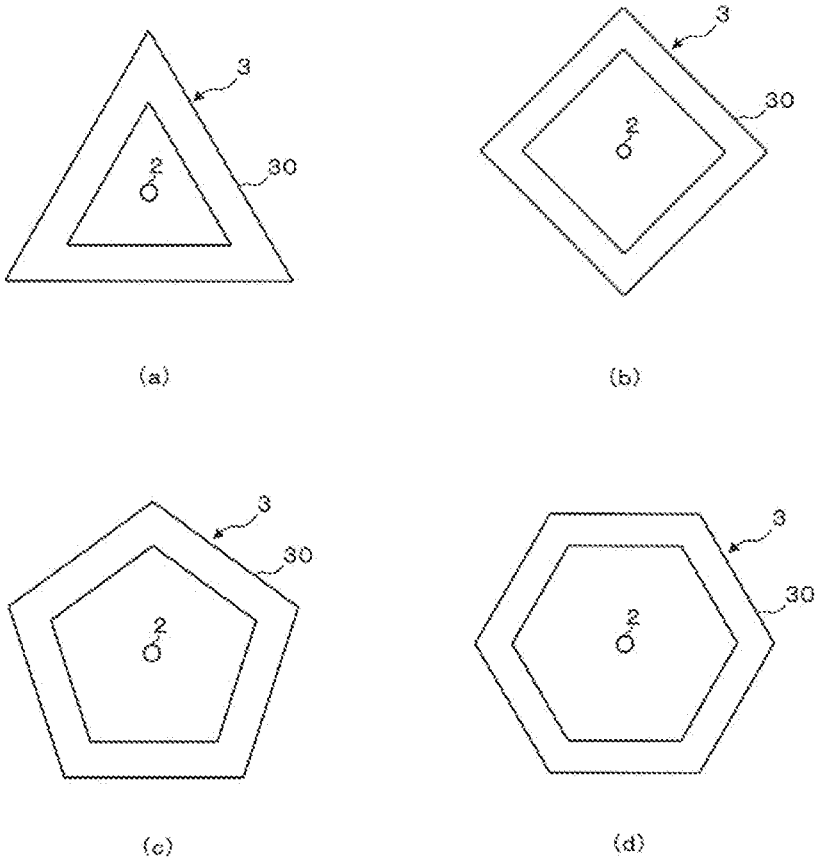

METALLIC ROOF MATERIAL AND ROOFING METHOD USING SAME

The present application is a U.S. National Stage of PCT International Patent Application No. PCT/JP2017/019200, filed May 23, 2017, which is hereby incorporated herein by reference.

TECHNICAL FIELD

The present invention relates to a metallic roof material that is tightened on a roof base by driving a tightening member, and a roofing method using the same.

BACKGROUND ART

The present inventors have attempted implementation of a metallic roof material as disclosed in the following Patent Document 1, i.e., a metallic roof material including a metallic front substrate; a back substrate disposed on a back side of the front substrate; and a core material made of a foamed resin filled between the front substrate and the back substrate. After being disposed on the roof base, such a metallic roof material is tightened to the roof base by driving a tightening member such as a nail or a screw.

CITATION LIST

Patent Literature

Japanese Patent No. 5864015 B

SUMMARY OF INVENTION

Technical Problem

When the tightening member is driven into the metallic roof material as described above, a pressure caused by the driving of the binding member may lead to a depression or buckling around the driven position of the tightening member. Such a depression or buckling will cause retention of moisture such as rain water that will cause corrosion of the metallic roof material, and deterioration of the design of the metallic roof material. In order to prevent the depression or buckling, a method of increasing a sheet thickness of the front substrate can be considered. However, such a method results in an increase in the weight of the roof.

The present invention has been made to solve the above problems. An object of the present invention is to provide a metallic roof material that can decrease a depression and buckling in the front substrate due to the driving of the tightening member, and a roofing method using the same.

Solution to Problem

The present invention relates to a metallic roof material comprising: a front substrate made of a metal sheet, the front substrate comprising a body portion formed into a box shape; a back substrate arranged on a back side of the front substrate so as to cover an opening of the body portion; and a core material filled between the body portion and the back substrate, the metallic roof material being tightened to a roof base by driving at least one tightening member into the body portion, wherein a top plate portion of the body portion comprises at least one protruding rib comprised of at least one protrusion disposed along a side of a polygon or along a circle, and wherein the metallic roof material is configured such that the tightening member is driven into an inner region of the protruding rib.

The present invention also relates to a roofing method using a metallic roof material comprising: a front substrate made of a metal sheet, the front substrate comprising a body portion formed into a box shape; a back substrate arranged on a back side of the front substrate so as to cover an opening of the body portion; and a core material filled between the body portion and the back substrate, a top plate portion of the body portion comprising at least one protruding rib comprised of at least one protrusion disposed along a side of a polygon or along a circle, wherein the roofing method comprises the steps of: placing the metallic roof material on a roof base; and driving at least one tightening member into an inner region of the protruding rib to tighten the metallic roof material to the roof base.

Advantageous Effects of Invention

According to the metallic roof material and the roofing method using the same according to the present invention, the protruding rib comprised of at least one protrusion disposed along a side of a polygon or along a circle is provided on the top plate portion of the body portion and the tightening member is driven into the inner region of the protruding rib, thereby enabling the depression or buckling in the front substrate due to the driving of the tightening members to be reduced.

BRIEF DESCRIPTION OF DRAWINGS

FIG. 1 is a front view showing a metallic roof material according to an embodiment of the present invention.

FIG. 2 is a back view showing the metallic roof material 1 in FIG. 1.

FIG. 3 is a cross-sectional view of the metallic roof material taken along the line III-III in FIG. 1.

FIG. 4 is an explanatory view showing another aspect of the body portion in FIG. 1.

FIG. 5 is explanatory view showing a roofing structure and roofing method using the metallic roof material 1 in FIG. 1.

FIG. 6 is an enlarged plan view of the region VI in FIG. 1.

FIG. 7 is a cross-sectional view taken along the line VII-VII in FIG. 6.

FIG. 8 is a plan view showing a circle that falls within the inner region in FIG. 6.

FIG. 9 is explanatory view showing a variation of the protruding rib in FIG. 6.

FIG. 10 is explanatory view showing a further variation of the protruding rib in FIG. 6.

FIG. 11 is an explanatory view showing a still another variation of the protruding rib in FIG. 6.

DESCRIPTION OF EMBODIMENTS

Embodiments for carrying out the present invention will be described with reference to the drawings.

Embodiments for Carrying out the Present Invention:

FIG. 1 is a front view showing a metallic roof material 1 according to an embodiment of the present invention, FIG. 2 is a back view showing the metallic roof material 1 in FIG. 1, FIG. 3 is a cross-sectional view of the metallic roof material 1 taken along the line III-III in FIG. 1, FIG. 4 is an explanatory view showing another aspect of the body portion in FIG. 1, and FIG. 5 is explanatory view showing a roofing structure and roofing method using the metallic roof material 1 in FIG. 1.

A metallic roof member 1 as shown in FIGS. 1 to 3 is arranged together with other metallic roof members on a roof base of a building such as a house, as shown in FIG. 5. As particularly shown in FIG. 3, the metallic roof member 1 includes a front substrate 10, a back substrate 11, and a core material 12.

The front substrate 10 is made of a metal sheet and appears on the outer surface of the roof as the metallic roof material 1 is placed on the roof base. The metal sheet making up the front substrate 10 that can be used includes a hot-dip Zn plated steel sheet, a hot-dip Al plated steel sheet, a hot-dip Zn plated stainless steel sheet, a hot-dip Al plated stainless steel sheet, a stainless steel sheet, an Al sheet, a Ti sheet, a coated hot-dip Zn plated steel sheet, a coated hot-dip Al plated steel sheet, a coated hot-dip Zn plated stainless steel sheet, a coated hot-dip Al plated stainless steel sheet, a coated stainless steel sheet, a coated Al sheet or a coated Ti sheet.

Preferably, the thickness of the metal sheet is 0.5 mm or less. An increasing thickness of the metal sheet will result in increased strength, while resulting in increased weight. The thickness of the metal sheet of 0.5 mm or less can prevent the weight of the metallic roof material 1 from becoming excessive, thereby keeping down the total weight of the roof when equipment such as a solar cell module, a solar water heater, an outdoor unit of an air conditioner and snow melting equipment is provided on the roof. In addition, the metal sheet has a thickness of 0.27 mm or more. The thickness of the metal sheet of 0.27 mm or more can ensure strength required for the roofing member, and sufficiently provide wind pressure resistance performance and tread-down properties. The wind pressure resistance performance refers to performance for which the metallic roof material 1 can withstand strong wind without buckling of the metallic roof material 1.

The front substrate 10 includes a box-shaped body portion 100 having a top plate portion 101 and peripheral wall portions 102. The body portion 100 is preferably formed by performing drawing or bulging processing on a metal sheet. By forming the box-shaped body portion 100 by performing the drawing or bulging processing, each of the side wall portions 102 can have a wall surface that is continuous in the circumferential direction of the front substrate 10, and any likelihood that water enters the inside of the body portion 100 can be reduced. However, it is also possible to bend the metal sheet having a shape as shown in FIG. 4 along the dashed lines in the figure to form the box-shaped body portion 100.

When the steel sheet (the hot-dip Zn plated steel sheet, the hot-dip Al plated steel sheet, the hot-dip Zn plated stainless steel sheet, the hot-dip Al plated stainless steel sheet, the stainless steel sheet, the Al sheet, the Ti sheet, the coated hot-dip Zn plated steel sheet, the coated hot-dip Al plated steel sheet, the coated hot-dip Zn plated stainless steel sheet, the coated hot-dip Al plated stainless steel sheet or the coated stainless steel sheet) is used as the metal sheet of the front substrate 10 and when the body portion 100 is formed by the drawing or bulging processing, the hardness of the peripheral wall portions 102 are increased by work hardening. More particularly, the Vickers hardness of each peripheral wall portion 102 can be increased to about 1.4 to 1.6 times the hardness before the working. The wind pressure resistance performance of the metal roofing member 1 is significantly improved by virtue of the fact that each peripheral wall portion 102 has the wall surface that is continuous in the circumferential direction of the front substrate 10, as described above, and by virtue of the fact that the hardness of each peripheral wall portion 102 is increased by work hardening.

The back substrate 11 is a member that is arranged on the back side of the front substrate 10 so as to covert an opening of the body portion 100. The back substrate 11 that can be used include lightweight materials such as an aluminum foil, aluminum vapor deposited paper, aluminum hydroxide paper, calcium carbonate paper, resin films or glass fiber paper and the like. The use of these lightweight materials for the back substrate 11 allows prevention of an increase in the weight of the metallic roof material 1.

The core material 12 is made of, for example a foamed resin or the like, and is filled between the body portion 100 of the front substrate 10 and the back substrate 11. The filling of the core material 12 between the body portion 100 of the front substrate 10 and the back substrate 11 can lead to a stronger adhesion of the core material 12 to the inside of the body portion 100 as compared with an embodiment where a backing material such as a resin sheet or the like is attached onto the back side of the front substrate 11, so that the performance required for the roofing materials, such as rainfall noise reduction, heat insulation and tread-down properties, can be improved.

The material of the core material 12 includes, but not limited to, for example, urethane, phenol and cyanurate resins. For roofing materials, however, certified noncombustible materials must be used. The test for certification of noncombustible material is conducted by a heat release test according to the cone calorimeter test method defined in ISO 5660-1. If the foamed resin for forming the core material 12 is urethane having a higher calorific value or the like, the thickness of the core material 12 may be decreased, or inorganic expandable particles may be incorporated into the foamed resin.

A height h of the body portion 100 filled with the core material 12 is preferably 4 mm or more and 8 mm or less. The height h of the body portion 100 of 4 mm or more enables sufficiently higher strength of the body portion 100, and improved wind pressure resistance. The height h of 4 mm or more can also provide improved heat insulation properties. The height h of the body portion 100 of 8 mm or less can prevent the organic mass of the core material 12 from becoming excessive, and can allow certification of noncombustible material to be more reliably obtained.

As shown in FIG. 5, the metallic roof material 1 is adapted such that a width direction 100*a* (a longitudinal direction) of the body portion 100 extends along a direction 4 parallel to an eave of the roof, and a depth direction 100*b* (a short direction) of the body portion 100 as described below extends along an eave-ridge direction 5 of the roof. Each metallic roof material 1 is fastened to the roof base by driving fastening members such as screws or nails. Further, in the eave-ridge direction 5, the metallic roof material 1 on the ridge side is arranged on the roof base while being overlapped onto the metallic roof material 1 on the eave side.

Returning to FIG. 1, the top plate portion 101 of the body portion 100 includes a plurality of tightening indicators 2 spaced apart from each other along the width direction 100*a* of the body portion 100, and a protruding rib 3 arranged around each tightening indicator 2. The tightening indicators 2 and the protruding ribs 3 are described below in more detail.

FIG. 6 is an enlarged plan view of the region VI in FIG. 1, FIG. 7 is a cross-sectional view taken along the line VII-VII in FIG. 6, and FIG. 8 is a plan view showing a circle that falls within the inner region in FIG. 6. The tightening indicators 2 indicate positions for driving the tightening members into the metallic roof material 1. As shown in FIGS. 6 and 7, each of the tightening indicators 2 of this embodiment is composed of a concave portion having a circular shape in plan view. However, each of the tightening indicators 2 may present any other form in which the operator can visually or tactually recognize the tightening position of the tightening member, such as, for example, a convex body, an opening, or a printed or engraved symbol.

Each protruding rib 3 is formed by a plurality of protrusions 30 disposed along a side of a rectangle extending in the depth direction 100*b* of the body portion 100. Each tightening indicator 2 is disposed in an inner region 3*a* of each protruding rib 3. That is, the metallic roof material 1 according to the present embodiment is configured such that the tightening member is driven into the inner region 3*a* of the protruding rib 3, and the tightening member is driven into the inner region 3*a* of the protruding rib 3 when carrying out roofing (creating a roof) as shown in FIG. 5.

As shown in FIG. 7, each protrusion 30 is structured by allowing a part of the metal sheet forming the top plate portion 101 to protrude. A vertical inner wall 30*a* of each protrusion 30 extends in a direction intersecting with a wall surface of the inner region 3*a* of the protruding rib 3, and can be resistant to deformation of the inner region 3*a* when the tightening member is tightened to the inner region 3*a* (the tightening indicator 2) of the protruding rib 3. That is, the tightening member is driven into the inner region 3*a* (the tightening indicator 2) of the protruding rib 3, thereby reducing a depression or buckling of the front substrate 10 due to the driving of the tightening member.

As shown in FIG. 6, each protruding rib 3 is provided with a plurality of opening portions 31 that communicate an outer region 3*b* with the inner region 3*a* of the protruding rib 3. For the protruding rib 3 according to the present embodiment, the four opening portions 31 are formed by lacking the protrusions 30 at both ends of the upper and lower sides of the rectangle. In the opening portion 31, surfaces under the same conditions as those of the surfaces of the inner region 3*a* and the outer region 3*b* of the protruding rib 3 preferably extend. By providing the opening portion 31 in the protruding rib 3, a flow of air passing inside and outside the protruding rib 3 can be ensured even if an upper portion of the protruding rib 3 is blocked by the other metallic roof material as shown in FIG. 5. This can allow evaporation of moisture such as rainwater to be facilitated even if the moisture enters the inner region 3*a* of the protruding rib 3, thereby reducing any risk where moisture will remain in the inner region 3*a* of the protruding rib 3.

Here, the opening portions 31 positioned at both ends of the lower side of the rectangle form eave side opening portions 31E positioned on the eave sides of the protruding rib 3 when the metallic roof material 1 is disposed on the roof base. The eave side means a downstream side in a flow direction of the roof. By providing such eave side opening portions 31E, the moisture that has entered the inner region 3*a* of the protruding rib 3 can escape through the eave side opening portions 31E to the outer region 3*b* of the protruding rib 3, thereby enabling a risk where the moisture will remain in the inner region 3*a* of the protruding rib 3 to be reduced.

A ratio of the opening portions 31 in each protruding rib 3 (hereinafter referred to as an opening ratio) is preferably 50% or less. The opening ratio can be defined by the following equation:

$$\text{Opening Ratio (\%)}=(\text{Total of Center Angles Corresponding to Opening Portions}/360)\times 100$$

The center angles corresponding to the opening portions are angles θ1 to θn between straight lines corresponding to the respective opening portions 31*a* when a circle having the largest radius that falls within the inner region 3*a* is drawn as shown in FIG. 8, and the straight lines passing through the center of the circle and both inner ends of each opening portion 31*a* are drawn. In the case of the embodiment where the four opening portions 31*a* are provided on the protruding rib 3 as shown in FIG. 8, it is expressed as the opening ratio $(\%)=\{(\theta 1+\theta 2+\theta 3+\theta 4)/360\}\times 100$. The circle that falls within the inner region 3*a* means a circle that is located inside the protruding rib 3 and that does not extend beyond the vertical inner wall 30*a* of all the protruding portions 30. Further, the symbol n is an arbitrary positive number corresponding to the number of opening portions 31. As will be described later with reference to Examples, the opening ratio of the protruding rib 3 of 50% or less can suppress deformation of the front substrate 10 due to the driving of the tightening member to a smaller level.

Each protrusion 30 preferably has a height H of 0.2 mm or more. The height H corresponds to a distance between a surface of the inner region 3*a* or the outer region 3*b* of the protruding rib 3 and a top of the protruding portion 30. As will be described later with reference to Examples, the height of each protrusion 30 of 0.2 mm or more can suppress the deformation of the front substrate 10 due to the driving of the tightening member to a smaller level.

A value (W/H) obtained by dividing a width W of each protrusion 30 by the height H of each protrusion 30 is preferably 3 or more. The width W corresponds to a distance between the vertical inner wall 30*a* and a vertical outer wall of the protrusion 30. As will be described later with reference to Examples, the value of W/H of 3 or more can avoid the processing of forming the protrusions 30 from being severe, and more reliably avoid cracks from occurring in a coated film formed on the surface of the metal sheet forming the top plate portion 101.

It is preferable that a shortest distance L from the center position of the inner region 3*a* to each protrusion 30 is 5 mm or more and 20 mm or less. The shortest distance L from the center position of the inner region 3*a* to each protrusion 30 can be defined by a radius of a circle having the largest radius that falls within the inner region 3*a* (see FIG. 8). As will be described later with reference to Examples, the shortest distance L of 5 mm or more and 20 mm or less can suppress the deformation of the front substrate 10 due to the driving of the tightening member to a smaller level.

Next, FIG. 9 is explanatory view showing a variation of the protruding rib 3 in FIG. 6. As shown in FIGS. 9(*a*) to 9(*h*), the protrusion(s) 30 forming each protruding rib 3 may be arranged along a circle. As shown in FIGS. 9(*a*), (*e*), (*f*) and (*g*), the protruding rib 3 may be structured by one protruding portion 30, and as shown in FIGS. 9(*b*) to (*d*) and (*h*), the protruding rib 3 may be structured by a plurality of protruding portions 30.

As shown in FIGS. 9(*b*) to 9(*d*), a plurality of opening portions 31 may be arranged to face each other with the center positions of the protruding rib 3 interposed therebetween, or as shown in FIGS. 9(*e*) and (*f*), one opening portion 31 may be provided such that the opening rate of the protruding rib 3 is 50%. As shown in FIG. 9(*h*), a part of the opening portions 31 may be the eave side opening portion 31E while the opening ratio of the protruding rib 3 is 50%.

Next, FIG. 10 is explanatory view showing a further variation of the protruding rib 3 in FIG. 6. As shown in FIGS. 10(*a*) to 10(*h*), the protrusion(s) 30 forming each protruding rib 3 may be disposed along a side of a square. As shown in FIGS. 10(*a*) and 10(*e*), the protruding rib 3 may be structured by one protrusion 30. As shown in FIGS. 10(*b*) to 10(*d*) and FIGS. 10(*f*) to (*h*), the protruding rib 3 may be structured by a plurality of protrusions 30.

As shown in FIGS. 10(*b*) to (*d*), (*f*) and (*g*), a plurality of opening portions 31 may be arranged to face each other with the center positions of the protruding rib 3 interposed therebetween, or as shown in FIG. 10(*e*), one opening portion 31 may be provided such that the opening ratio of the protruding rib 3 is 50%. As shown in FIG. 10(*h*), a part of the opening portions 31 may be the eave opening portion 31E while the opening ratio of the protruding rib 3 is 50%.

Next, FIG. 11 is explanatory view showing other variation of the protruding rib 3 in FIG. 6. As shown in FIGS. 11(*a*) to 11(*e*), the protruding portion 30 forming the protruding rib 3 may be disposed along sides of a triangle, a rhombus (quadrangle), a pentagon and an octagon. Further, the protrusion 30 may be arrange along sides of a polygon having twist angles. Even if the protrusions 30 are arranged along the sides of the triangle, rhombus (quadrangle), pentagon and octagon as shown in FIGS. 11(*a*) to (*e*), the opening portion(s) can be provided as shown in FIGS. 9 and 10.

EXAMPLES

Examples are now illustrated. The inventors experimentally produced samples of the metallic roof material 1 under conditions given below.

A coated hot-dip Zn-55% Al plated steel sheet, a coated hot-dip Zn-6% Al-3% Mg plated steel sheet or a coated hot-dip Al plated steel sheet, which had a size of 0.20 mm to 0.6 mm, was used as the material of the front substrate 10.

Glass fiber paper having a size of 0.2 mm, Al metallized paper having a size of 0.2 mm, a PE resin film having a size of 0.2 mm, an Al foil having a size of 0.1 mm or a coated hot-dip Zn plated steel sheet having a size of 0.27 mm was used as the back substrate 11.

A two-liquid mixture type foam resin was used as the core material 12. The mixing ratio of a polyol component and isocyanate, phenol or cyanurate component was 1:1, in a ratio by weight.

The front substrate 10 was processed to have a predetermined thickness and shape of the roof material. The back substrate 11 was then disposed on the back side of the front substrate 10 so as to cover the opening of the body portion 100, and the foam resin was injected into the gap between the body portion 100 of the front substrate 10 and the back substrate 11, using a commercially available high-pressure injection machine. Foaming of the resin was accomplished by maintaining the resin for 2 minutes in a mold at which the temperature was adjusted to 70° C. by circulating hot water; subsequently, the roof material was removed from the mold, and was allowed to stand for 5 minutes at room temperature of 20° C., to complete foaming of the resin.

After complete of the foaming of the resin, the metal sheet extending from a lower edge of the body portion 100 toward the outer direction of the body portion 100 was cut such that a protruding width of a flange was 5 mm, and the cut metal sheet was subjected to a bending process by means of a bender to have a predetermined shape. The dimensions of the final metallic roof material 1 were 414 mm×910 mm. The thickness of the final roof material was in the range of from 3 mm to 8 mm.

Such samples were subjected to the following evaluations: (1) evaluation of the weight of the roof material; (2) evaluation of a depression during tightening; (3) evaluation of cracking on the coated film; and (4) evaluation of ease of rainwater flow, while changing the shape of each protruding rib 3, the presence or absence of the eave side opening portion 31E, the height H of the protruding portion 30, the shortest distance L from the center position of the inner region 3*a* to the protruding portion 30, the value obtained by dividing the width W of the protrusion 30 by the height H of the protrusion 30, and the opening ratio (a ratio of the opening portions 31 in the protruding rib 3). The results are shown in the Table as shown below.

TABLE 1

Details of Samples and Performance Evaluation Results

| Classification | | Details of Samples | | | | | |
|---|---|---|---|---|---|---|---|
| | | Thickness (mm) | Rib Shape | Presence or Absence of Eave Side | Protrusion Height H (mm) | Shortest Distance L (mm) | Protrusion Width W / Protrusion Height H |
| Examples | 1 | 0.3 | Circular | Present | 0.3 | 10 | 17 |
| | 2 | 0.3 | Rectangular | Present | 0.3 | 10 | 17 |
| | 3 | 0.3 | Triangular | Present | 0.8 | 15 | 19 |
| | 4 | 0.35 | Pentagonal | Present | 1 | 20 | 10 |
| | 5 | 0.35 | Hexagonal | Present | 1 | 20 | 10 |
| | 6 | 0.5 | Hexagonal | Present | 1 | 20 | 3 |
| | 7 | 0.4 | Circular | Present | 0.5 | 10 | 10 |
| Comparative Examples | 1 | 0.6 | Triangular | Present | 0.5 | 10 | 10 |
| | 2 | 0.3 | Square | Absent | 0.3 | 10 | 10 |
| | 3 | 0.3 | Square | Present | 0.3 | 23 | 15 |
| | 4 | 0.4 | Pentagonal | Present | 0.1 | 10 | 10 |
| | 5 | 0.4 | Hexagonal | Present | 0.3 | 10 | 2 |
| | 6 | 0.4 | Circular | Present | 1.1 | 10 | 2.7 |
| | 7 | 0.27 | Circular | Absent | 0.2 | 5 | 15 |
| | 8 | 0.3 | Square | Absent | 0.3 | 5 | 10 |

TABLE 1-continued

| Details of Samples and Performance Evaluation Results | | | | | | |
|---|---|---|---|---|---|---|
| | | | Performance Evaluation Results | | | |
| Classification | | Details of Samples Opening Ratio (%) | Roof Material Weight | Depression during Tightening | Cracking on Coated Film | Ease of Rainwater Flow |
| Examples | 1 | 10 | ○ | ○ | ○ | ○ |
| | 2 | 12.5 | ○ | ○ | ○ | ○ |
| | 3 | 20 | ○ | ○ | ○ | ○ |
| | 4 | 40 | ○ | ○ | ○ | ○ |
| | 5 | 40 | ○ | ○ | ○ | ○ |
| | 6 | 40 | ○ | ○ | ○ | ○ |
| | 7 | 15 | ○ | ○ | ○ | ○ |
| Comparative Examples | 1 | 30 | Δ | ○ | ○ | ○ |
| | 2 | 52 | ○ | Δ | ○ | Δ |
| | 3 | 15 | ○ | Δ | ○ | ○ |
| | 4 | 15 | ○ | Δ | ○ | ○ |
| | 5 | 15 | ○ | ○ | Δ | ○ |
| | 6 | 15 | ○ | ○ | Δ | ○ |
| | 7 | 0 | ○ | ○ | ○ | Δ |
| | 8 | 0 | ○ | ○ | ○ | Δ |

(1) Evaluation Criteria of Roof Material Weight

The unit weight of each roof material was measured and evaluated in accordance with the following criteria. It should be noted that the evaluation was made based on an assumption that a standard 130 N/m$^2$ solar cell module was placed on the roof, using the following evaluation criteria based on the total weight of the entire roof including the roof material.

○: unit weight of roof material of less than 250 N/m$^2$; and

Δ: unit weight of roof material of 250 N/m$^2$ or more.

(2) Evaluation Criteria of Depression during Tightening

As the tightening member, a commercially available best screw (a diameter of 4.0 mmφ×a length of 35 mm) from YAMAKI SANGYO co., ltd., and an impact driver (TD136D from Makita Corporation) were used to tighten two roof material sheets stacked to each other. For the depression during the tightening, the depression of the tightened roof material on the upper side were measured by means of a gap gauge and evaluated according to the following evaluation criteria:

○: Depression of less than 2 mm during tightening; and

Δ: Depression of 2 mm or more during tightening.

(3) Evaluation of Cracking on Coated Film

The cracking on the coated film which occurred on a coated steel sheet when forming the protrusion 30 was visually observed with a magnifying glass at magnitudes of 10 times, and evaluated according to the following evaluation criteria:

○: No cracking on the coated film was observed or minor cracking was observed; and Δ: Significant cracking on the coated film was observed.

(4) Ease of Rainwater Flow

The roof material was inclined at a gradient of 15°, 1000 mL of tap water was allowed to flow over the roof material, and a situation where the water remained in the inner region 3*a* of the protruding rib 3 was visually evaluated according to the following evaluation criteria:

○: Water fluently flowed and almost no water remained in the inner region;

Δ: Water remained.

As shown in Comparative Example 1, when the thickness of the metal sheet forming the front substrate 10 was 0.6 mm, the unit weight of the roof material was 250 N/m$^2$ or more, and the weight of the roof material was evaluated as Δ. On the other hand, as shown in the Examples, the unit weight of the roof material was able to be less than 250 N/m$^2$ by the thickness of the metal sheet forming the front substrate 10 being 0.5 mm or less. These results indicated that the thickness of the metal sheet forming the front substrate 10 is preferably 0.5 mm or less.

As shown in Comparative Example 2, when the opening ratio of the protruding rib 3 was more than 50%, the depression during tightening was 2 mm or more, and the depression during tightening was evaluated as Δ. On the other hand, as shown in Examples, when the opening ratio was 50% or less, the depression during tightening could be less than 2 mm. These results indicated that the opening ratio is preferably 50% or less.

As shown in Comparative Example 3, when the shortest distance L from the center position of the inner region 3*a* to the protrusion 30 was more than 20 mm, the depression during tightening was 2 mm or more, and the depression during tightening was evaluated as Δ. On the other hand, as shown in Examples, when the shortest distance L was 20 mm or less, the depression during tightening could be less than 2 mm. These result indicated that the shortest distance L is preferably 20 mm or less. In addition, when the shortest distance L is decreased, the protrusion 30 may become a barrier and hinder the fastening work when the roof material is fastened by a nail or a screw using a hammer, a driver, or an electric tool. For this reason, the shortest distance L is preferably 5 mm or more.

As shown in Comparative Example 4, when the height H of the protrusion 30 was less than 0.2 mm, the depression during tightening was 2 mm or more, and the depression during tightening was evaluated as Δ. On the other hand, as shown in Examples, when the height H of the protrusion 30 was 0.2 mm or more, the depression during tightening could be less than 2 mm. These result indicated that the height H of the protrusion 30 is preferably 0.2 mm or more.

As shown in Comparative Examples 5 and 6, when the value obtained by dividing the width W of the protrusion 30 by the height H of the protrusion 30 was less than 3, cracking occurred on the coated film, and the cracking on the coated film was evaluated as Δ. On the other hand, as shown in Examples, when the value obtained by dividing the width W of the protrusion 30 by the height H of the protrusion 30 was 3 or more, the cracking on the coated film could be avoided. These results indicated that the value obtained by dividing the width W of the protrusion 30 by the height H of the protrusion 30 is preferably 3 or more.

As shown in Comparative Examples 2, 7, and 8, when the eave side opening portion 31E was not provided, water remained in the inner region 3*a* of the protruding rib 3, and the ease of rainwater flow was evaluated as Δ. On the other hand, as shown in the Examples, when the eave side opening portion(s) 31E was/were provided, water remaining in the inner region 3*a* of the protruding rib 3 could be avoided. These results indicated that it is preferable to provide the eave side opening portion(s) 31E.

In the metallic roof material 1 and the roofing method using the metallic roof material 1, the top plate portion 101 of the body portion 100 comprises at least one protruding rib 3 composed of at least one protruding portion 30 disposed along the side of the polygon or along the circle, and the tightening member is driven into the inner region 3*a* of the protruding rib 3, so that the depression or buckling of the front substrate 10 due to the driving of the tightening member can be reduced.

Further, the protruding rib 3 is provided with at least one opening portion 31 for communicating the outer region 3*b* with the inner region 3*a* of the protruding rib 3, so that the flow of air passing inside and outside the protruding rib 3 can be ensured even if the upper portion of the projected rib 3 is blocked by the other metallic roof material. Thus, even if moisture such as rainwater enters the inner region 3*a* of the protruding rib 3, evaporation of the water can be promoted, thereby reducing a risk where moisture remains in the inner region 3*a* of the protruding rib 3.

Furthermore, at least one opening portion 31 includes an eave side opening portion 31E located on the eave side of the protruding rib 3 when the metallic roof material 1 is disposed on the roof base, so that moisture that has entered the inner region 3*a* can escape through the eave side opening portion 31E to the outer region 3*b* of the protruding rib 3, thereby reducing a risk where the moisture will remain in the inner region 3*a* of the protruding rib 3.

Moreover, the ratio (opening ratio) of the opening portions 31 in the protruding rib 3 is 50% or less, so that deformation of the front substrate 10 due to the driving of the tightening member can be suppressed to a smaller level.

Also, the height H of the protrusion 30 is 0.2 mm or more, so that deformation of the front substrate 10 due to the driving of the tightening member can be suppressed to a smaller level.

Further, the value (W/H) obtained by dividing the width W of the protrusion 30 by the height H of the protrusion 30 is 3 or more, so that cracking can be more reliably prevented from occurring on the coated film formed on the surface of the metal sheet forming the top plate portion 101.

Furthermore, the shortest distance from the center position of the inner region 3*a* to the protrusion 30 is 5 mm or more and 20 mm or less, so that deformation of the front substrate 10 due to the driving of the tightening member can be suppressed to a smaller level.

Moreover, the sheet thickness of the metal sheet forming the front substrate 10 is 0.5 mm or less, so that excessively increased weight of the metallic roof material 1 can be more reliably avoided.

What is claimed is:

1. A metallic roof material comprising: a front substrate made of a metal sheet, the front substrate comprising a body portion formed into a box shape; a back substrate arranged on a back side of the front substrate so as to cover an opening of the body portion; and a core material made of a foam resin is filled between the body portion and the back substrate, the metallic roof material being tightened to a roof base by driving at least one tightening member into the body portion, wherein a top plate portion of the body portion comprises at least one protruding rib comprised of at least one protrusion formed in a part of the metal sheet and disposed along a side of a polygon or along a circle, and wherein the metallic roof material is configured such that the tightening member is driven into an inner region of the protruding rib, and wherein the at least one protruding rib further comprises at least one opening portion that communicates an outer region with the inner region of the protruding rib.

2. The metallic roof material according to claim 1, wherein the at least one opening portion includes an eave side opening located on an eave side of the at least one protruding rib when the metallic roof material is disposed on the roof base.

3. The metallic roof material according to claim 1, wherein a ratio of the at least one opening portions portion in the at least one protruding rib is 50% or less.

4. The metallic roof material according to claim 1, wherein the at least one protrusion has a height of 0.2 mm or more.

5. The metallic roof material according to claim 4, wherein a value obtained by dividing a width of the at least one protrusion by the height of the at least one protrusion is 3 or more.

6. The metallic roof material according to claim 1, wherein a shortest distance from a center position of the inner region to the at least one protrusion is between 5 mm and 20 mm.

7. The metallic roof material according to claim 1, wherein the metal sheet forming the front substrate has a thickness of 0.5 mm or less.

8. A roofing method using a metallic roof material comprising: a front substrate made of a metal sheet, the front substrate comprising a body portion formed into a box shape; a back substrate arranged on a back side of the front substrate so as to cover an opening of the body portion; and a core material made of a foam resin is filled between the body portion and the back substrate, a top plate portion of the body portion comprising at least one protruding rib comprised of at least one protrusion formed in a part of the metal sheet and disposed along a side of a polygon or along a circle and at least one opening portion that communicates an outer region with an inner region of the at least one protruding rib, the roofing method comprising the steps of:

placing the metallic roof material on a roof base; and driving at least one tightening member into the inner region of the at least one protruding rib to tighten the metallic roof material to the roof base.

* * * * *